US008245431B2

(12) United States Patent
Werner

(10) Patent No.: US 8,245,431 B2
(45) Date of Patent: Aug. 21, 2012

(54) DAMPENED RECOIL REST FOR SUPPORTING A RIFLE

(76) Inventor: Theodore J. Werner, Huntington Station, NY (US)

( * ) Notice: Subject to any disclaimer, the term of this patent is extended or adjusted under 35 U.S.C. 154(b) by 462 days.

(21) Appl. No.: 12/586,829

(22) Filed: Sep. 29, 2009

(65) Prior Publication Data

US 2010/0170128 A1 Jul. 8, 2010

Related U.S. Application Data

(60) Provisional application No. 61/204,500, filed on Jan. 7, 2009.

(51) Int. Cl.
*F41C 27/00* (2006.01)

(52) U.S. Cl. ..... 42/94; 73/167; 89/37.04

(58) Field of Classification Search ..... 42/94; 73/167; 89/37.01, 37.03, 37.04, 37.14; 248/177.1, 248/183.2, 186.2, 187.1, 576, 577, 578, 594
See application file for complete search history.

(56) References Cited

U.S. PATENT DOCUMENTS

| | | | | |
|---|---|---|---|---|
| 499,315 | A * | 6/1893 | Borchardt | 89/132 |
| 2,817,233 | A * | 12/1957 | Dower et al. | 73/167 |
| 4,333,385 | A * | 6/1982 | Culver | 89/37.04 |
| 5,811,720 | A * | 9/1998 | Quinnell et al. | 89/37.04 |
| 8,109,028 | B2 * | 2/2012 | Roberts et al. | 42/94 |
| 2007/0068379 | A1 * | 3/2007 | Sween et al. | 89/37.04 |
| 2008/0134555 | A1 * | 6/2008 | Werner | 42/69.01 |

* cited by examiner

*Primary Examiner* — Gabriel Klein
(74) *Attorney, Agent, or Firm* — Charles E. Baxley

(57) ABSTRACT

A dampened recoil rest for supporting a rifle for enabling a shooter to operate the rifle with adjustable attenuation of recoil felt by the shooter, eliminating damage to the rifle by progressively absorbing or attenuating recoil, with the sight remaining on the target thereby eliminating a need to reacquire the target, without having to add additional weight to absorb the recoil, and with comfortable transfer of the recoil from the rifle to the shooter's shoulder. The rest includes a stationary base assembly, a rotating base assembly, a recoil attenuating assembly, and a rifle support assembly. The stationary base assembly is for attaching to a bench top. The rotating base assembly is rotatably attached to the stationary base assembly. The recoil attenuating assembly is operatively connected to the rotating base assembly. The rifle support assembly is operatively connected to the recoil attenuating assembly and is for supporting the rifle.

43 Claims, 11 Drawing Sheets

DAMPENED RECOIL REST FOR SUPPORTING A RIFLE

1. CROSS REFERENCE TO RELATED APPLICATIONS

The instant nonprovisional patent application claims priority from provisional patent application No. 61/204,500, filed on Jan. 7, 2009, by Theodore J. Werner, for a KIT FOR DAMPENED RECOIL OF FIREARM, and incorporated herein by reference thereto.

2. BACKGROUND OF THE INVENTION

A. Field of the Invention

The embodiments of the present invention relate to a dampened recoil rest for supporting a rifle, and more particularly, the embodiments of the present invention relate to a dampened recoil rest for supporting a rifle for enabling a shooter to operate the rifle with adjustable attenuation of recoil felt by the shooter, eliminating damage to the rifle by progressively absorbing or attenuating recoil, with the sight remaining on the target thereby eliminating a need to reacquire the target, without having to add additional weight to absorb the recoil, and with comfortable transfer of the recoil from the rifle to the shooter's shoulder.

B. Description of the Prior Art

Currently, there exists in the art the following problems:

- Rifles produce recoil that is uncomfortable to many shooters.
- Current designs of rests that eliminate recoil could cause damage to the rifle, especially its stock, because the amount of resistance often is excessive, thus causing too much stress to be absorbed by the stock.
- At times it is desirable for the shooter to select an amount of recoil to deal with. This selection is quite difficult to achieve using shooting rests according to current designs.
- Current designs of shooting rests that eliminate recoil do not return to battery, i.e., they move all over a bench top. Thus, the target moves out of the field of view, thereby compromising target reacquisition.
- Many popular shooting rests require addition of a heavy weight to attenuate recoil. This weight addition is inconvenient and cumbersome.
- Many popular shooting rests do not allow the shooter to shoot the rifle comfortably from the shoulder.

Numerous innovations for firearm accessories have been provided in the prior art. Even though these innovations may be suitable for the individual purposes to which they address, nevertheless, they differ from the embodiments of the present invention in that they do not teach a dampened recoil rest for supporting a rifle for enabling a shooter to operate the rifle with adjustable attenuation of recoil felt by the shooter, eliminating damage to the rifle by progressively absorbing or attenuating recoil, with the sight remaining on the target thereby eliminating a need to reacquire the target, without having to add additional weight to absorb the recoil, and with comfortable transfer of the recoil from the rifle to the shooter's shoulder.

3. SUMMARY OF THE INVENTION

Thus, an object of the embodiments of the present invention is to provide a dampened recoil rest for supporting a rifle for enabling a shooter to operate the rifle with adjustable attenuation of recoil felt by the shooter, eliminating damage to the rifle by progressively absorbing or attenuating recoil, with the sight remaining on the target thereby eliminating a need to reacquire the target, without having to add additional weight to absorb the recoil, and with comfortable transfer of the recoil from the rifle to the shooter's shoulder, which avoids the disadvantages of the prior art.

Briefly stated, another object of the embodiments of the present invention is to provide a dampened recoil rest for supporting a rifle for enabling a shooter to operate the rifle with adjustable attenuation of recoil felt by the shooter, eliminating damage to the rifle by progressively absorbing or attenuating recoil, with the sight remaining on the target thereby eliminating a need to reacquire the target, without having to add additional weight to absorb the recoil, and with comfortable transfer of the recoil from the rifle to the shooter's shoulder. The rest includes a stationary base assembly, a rotating base assembly, a recoil attenuating assembly, and a rifle support assembly. The stationary base assembly is for attaching to a bench top. The rotating base assembly is rotatably attached to the stationary base assembly. The recoil attenuating assembly is operatively connected to the rotating base assembly and is for enabling the shooter to operate the rifle with adjustable attenuation of the recoil felt by the shooter, with the sight remaining on the target thereby eliminating a need to reacquire the target, without having to add additional weight to absorb the recoil, with the comfortable transfer of the recoil from the rifle to the shooter's shoulder, and to eliminate damage to the rifle by progressively absorbing or attenuating recoil. The rifle support assembly is operatively connected to the recoil attenuating assembly and is for supporting the rifle.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying drawing.

4. BRIEF DESCRIPTION OF THE DRAWING

The figures of the drawing are briefly described as follows:

FIG. 1 is a diagrammatic rear perspective view of the dampened recoil rest of the embodiments of the present invention supporting a rifle and enabling a shooter to operate the rifle with adjustable attenuation of recoil felt by the shooter, eliminating damage to the rifle by progressively absorbing or attenuating recoil, with the sight remaining on the target thereby eliminating a need to reacquire the target, without having to add additional weight to absorb the recoil, and with comfortable transfer of the recoil from the rifle to the shooter's shoulder;

FIG. 2 is a diagrammatic front perspective view of the dampened recoil rest of the embodiments of the present invention supporting a rifle and enabling a shooter to operate the rifle with adjustable attenuation of recoil felt by the shooter, eliminating damage to the rifle by progressively absorbing or attenuating recoil, with the sight remaining on the target thereby eliminating a need to reacquire the target, without having to add additional weight to absorb the recoil, and with comfortable transfer of the recoil from the rifle to the shooter's shoulder;

5. LIST OF REFERENCE NUMERALS UTILIZED IN THE DRAWING

A. General

Figure 1:
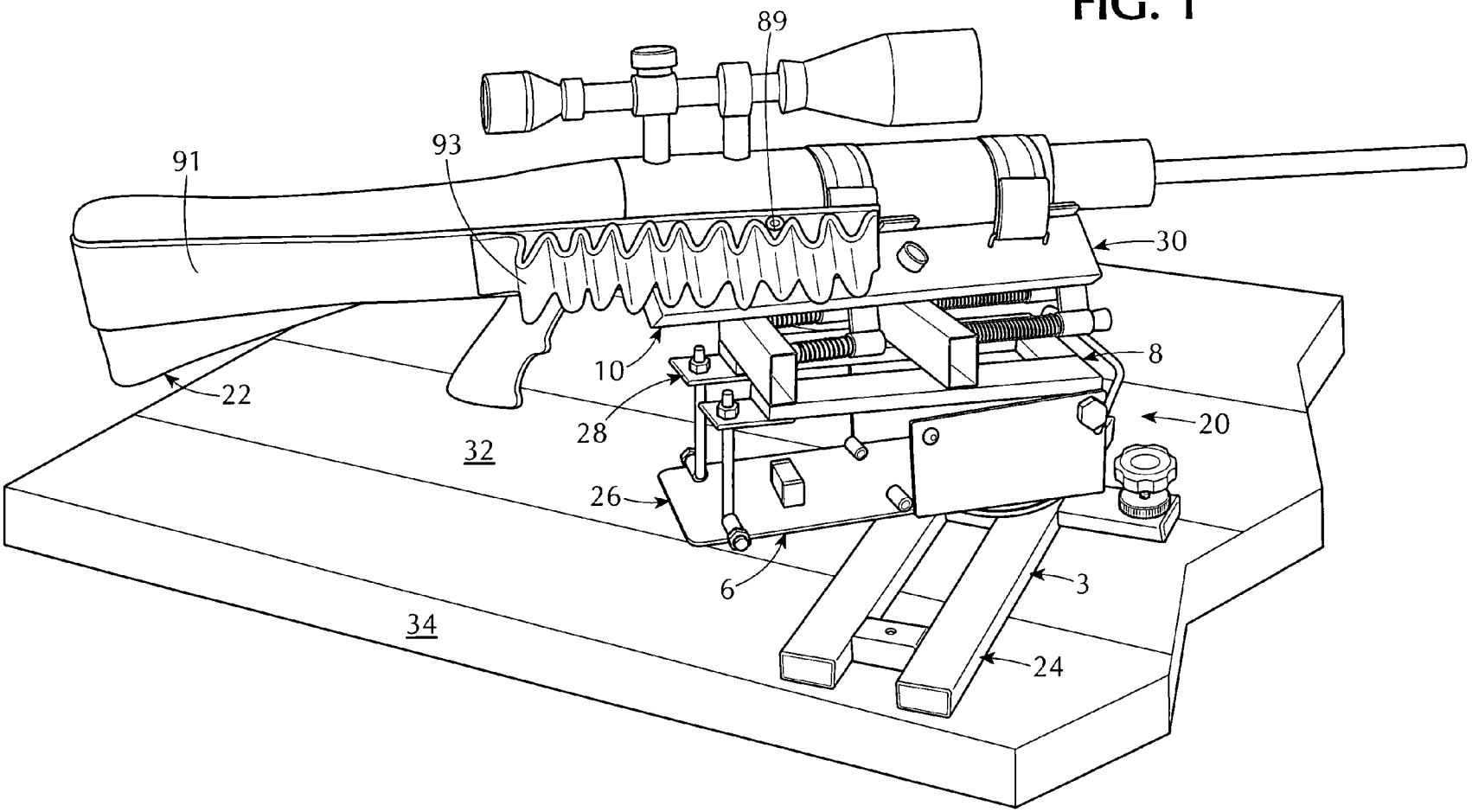

20 dampened recoil rest of embodiments of present invention for supporting rifle 22 for enabling shooter to operate rifle 22 with adjustable attenuation of recoil felt by shooter, eliminating damage to the rifle 22 by progressively absorbing or attenuating recoil, without having to sight-in rifle 22 after each shot, without having to add additional weight to absorb recoil, and with comfortable transfer of recoil from the firearm 22 to shooter's shoulder

B. Overall Configuration of Dampened Recoil Rest 20

24 stationary base assembly for attaching to bench top 32
26 rotating base assembly
28 recoil attenuating assembly for enabling shooter to operate rifle 22 with adjustable attenuation of recoil felt by the shooter, without having to sight-in rifle 22 after each shot, without having to add additional weight to absorb recoil, with comfortable transfer of recoil from rifle 22 to shooter's shoulder, and to eliminate damage to the rifle 22 by progressively absorbing or attenuating recoil
30 rifle support assembly
32 bench top
34 edge of bench top 32

C. Specific Configuration of Stationary Base Assembly 24

36 fixed portion of stationary base assembly 24 for resting on bench top 32
38 extendable grip arm of stationary base assembly 24 for engaging edge 34 of bench top 32
40 pair of axial channels of fixed portion 36 of stationary base assembly 24
42 axial part of fixed portion 36 of stationary base assembly 24
44 transverse part of fixed portion 36 of stationary base assembly 24
46 crossover point of fixed portion 36 of stationary base assembly 24
48 threaded shaft of fixed portion 36 of stationary base assembly 24
50 pair of free ends of transverse part 44 of fixed portion 32 of stationary base assembly 24
52 pair of threaded through bores of pair of free ends 50 of transverse part 44 of fixed portion 32 of stationary base assembly 24, respectively
53 pair of adjustable elevation jacks with locking knobs of fixed portion 32 of stationary base assembly 24
54 pair of axial parts of extendable grip arm 38 of stationary base assembly 24
56 cross member of extendable grip arm 38 of stationary base assembly 24 for abutting against edge 34 of bench top 32

D. Specific Configuration of Rotating Base Assembly 26

58 base part of rotating base assembly 26
60 pair of side parts of rotating base assembly 26
62 through bore of base part 58 of rotating base assembly 26
64 thrust bearing
65 threaded through bore 67 of base part 58 of rotating base assembly 26
66 portion of base part 58 of rotating base assembly 26
67 knobbed screw of rotating base assembly 26
68 chamber of rotating base assembly 26
69 carrying handle of rotating base assembly 26 for carrying dampened recoil rest 20
70 pair of through bores of each side part of pair of side parts 60 of rotating base assembly 26
71 pair of adjustable supports of rotating base assembly 26

E. Specific Configuration of Recoil Attenuating Assembly 28

72 base part of recoil attenuating assembly 28
74 pair of upright parts of recoil attenuating assembly 28
76 pair of rods of each upright part of pair of uprights parts 74 of recoil attenuating assembly 48
78 two pair of coil springs of recoil attenuating assembly 28
80 pair of sleeves of base part 72 of recoil attenuating assembly 28
82 fasteners
83 pair of tabs of base part 72 of recoil attenuating assembly 28

F. Specific Configuration of Rifle Support Assembly 30

84 body of rifle support assembly 30
86 pair of banks of body 84 of rifle support assembly 30
87 junction of pair of banks 86 of body 84 of rifle support assembly 30
88 two pair of sleeves of rifle support assembly 30
89 pair of threaded pins of rifle support assembly 30
90 compression damper of rifle support assembly 30
91 strap of rifle support assembly 30
92 one end of compression damper 90 of rifle support assembly 30
93 loops of strap 91 of rifle support assembly 30
94 other end of compression damper 90 of rifle support assembly 30
96 threaded rod of recoil attenuating assembly 28
98 cleats of rifle support assembly 30 for supporting rifle 22
100 strap of rifle support assembly 30 for maintaining rifle 22 in rifle support assembly 30

6. DETAILED DESCRIPTION OF THE PREFERRED EMBODIMENTS

A. General

Figure 2:
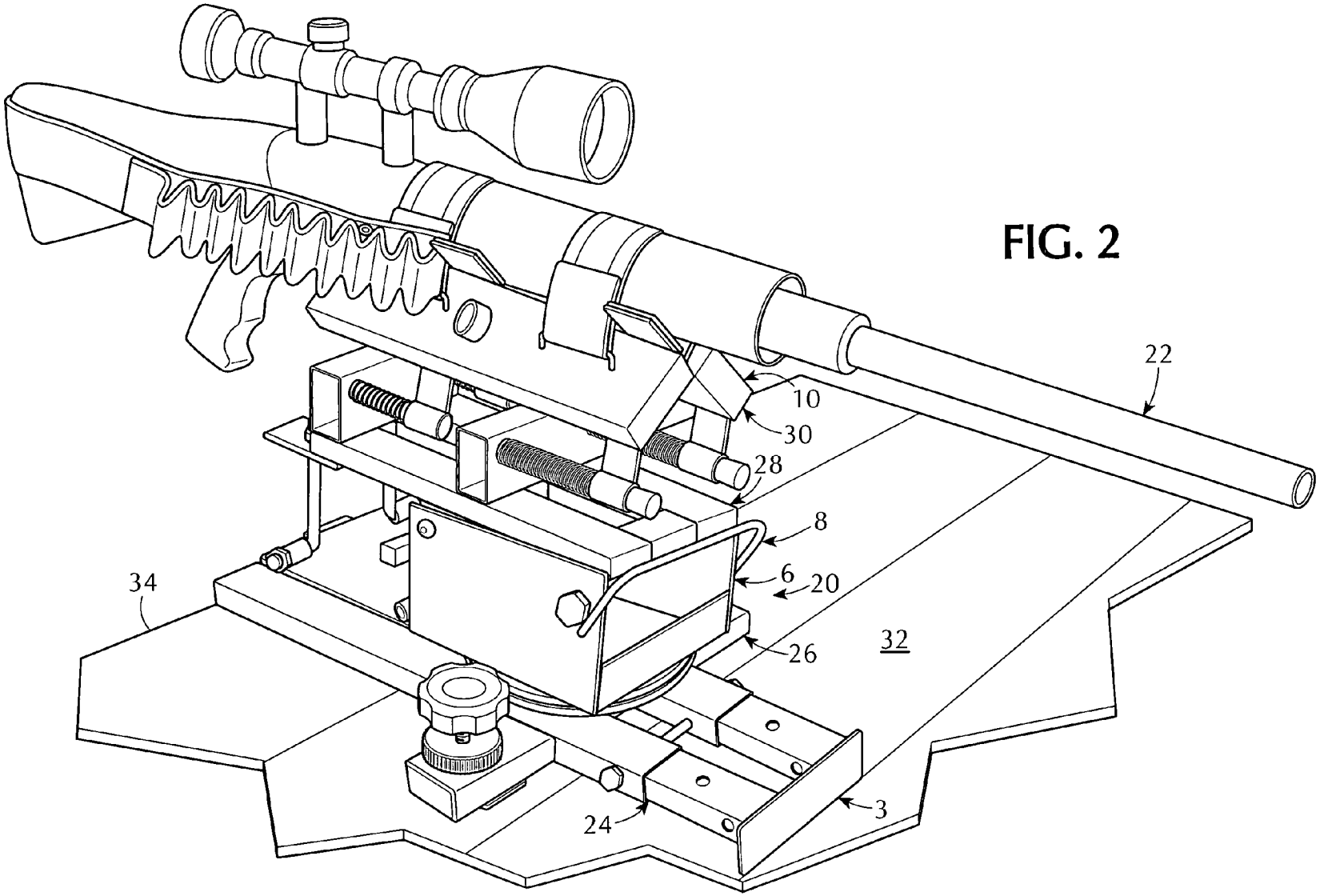

Referring now to the figures, in which like numerals indicate like parts, and particularly to FIGS. 1 and 2, which are, respectively, a diagrammatic rear perspective view of the dampened recoil rest of the embodiments of the present invention supporting a rifle and enabling a shooter to operate the rifle with adjustable attenuation of recoil felt by the shooter, eliminating damage to the rifle by progressively absorbing or attenuating recoil, with the sight remaining on the target thereby eliminating a need to reacquire the target, without having to add additional weight to absorb the recoil, and with comfortable transfer of the recoil from the rifle to the shooter's shoulder, and a diagrammatic front perspective view of the dampened recoil rest of the embodiments of the present invention supporting a rifle and enabling a shooter to operate the rifle with adjustable attenuation of recoil felt by the shooter, eliminating damage to the rifle by progressively absorbing or attenuating recoil, with the sight remaining on the target thereby eliminating a need to reacquire the target, without having to add additional weight to absorb the recoil, and with comfortable transfer of the recoil from the rifle to the shooter's shoulder, the dampened recoil rest of the embodiments of the present invention is shown generally at 20 for supporting a rifle 22 for enabling a shooter to operate the rifle 22 with adjustable attenuation of recoil felt by the shooter, eliminating damage to the rifle 22 by progressively absorbing or attenuating recoil, with the sight remaining on the target thereby eliminating a need to reacquire the target, without having to add additional weight to absorb the recoil, and with comfortable transfer of the recoil from the rifle 22 to the shooter's shoulder.

Eliminating damage to the rifle 22 by progressively absorbing or attenuating recoil is a key point because the progressive absorption of the recoil is the feature that emulates firing from the shoulder and eliminates the damage.

B. The Overall Configuration of the Dampened Recoil Rest 20

The dampened recoil rest 20 comprises a stationary base assembly 24, a rotating base assembly 26, a recoil attenuating assembly 28, and a rifle support assembly 30. The stationary base assembly 24 is for attaching to a bench top 32 having an edge 34. The rotating base assembly 26 is rotatably attached to the stationary base assembly 24. The recoil attenuating assembly 28 is operatively connected to the rotating base assembly 26 and is for enabling the shooter to operate the rifle 22 with adjustable attenuation of the recoil felt by the shooter, with the sight remaining on the target thereby eliminating a need to reacquire the target, without having to add additional weight to absorb the recoil, with the comfortable transfer of the recoil from the rifle 22 to the shooter's shoulder, and to eliminate damage to the rifle 22 by progressively absorbing or attenuating recoil. The rifle support assembly 30 is operatively connected to the recoil attenuating assembly 28 and is for supporting the rifle 22.

C. The Specific Configuration of the Stationary Base Assembly 24

Figure 3:
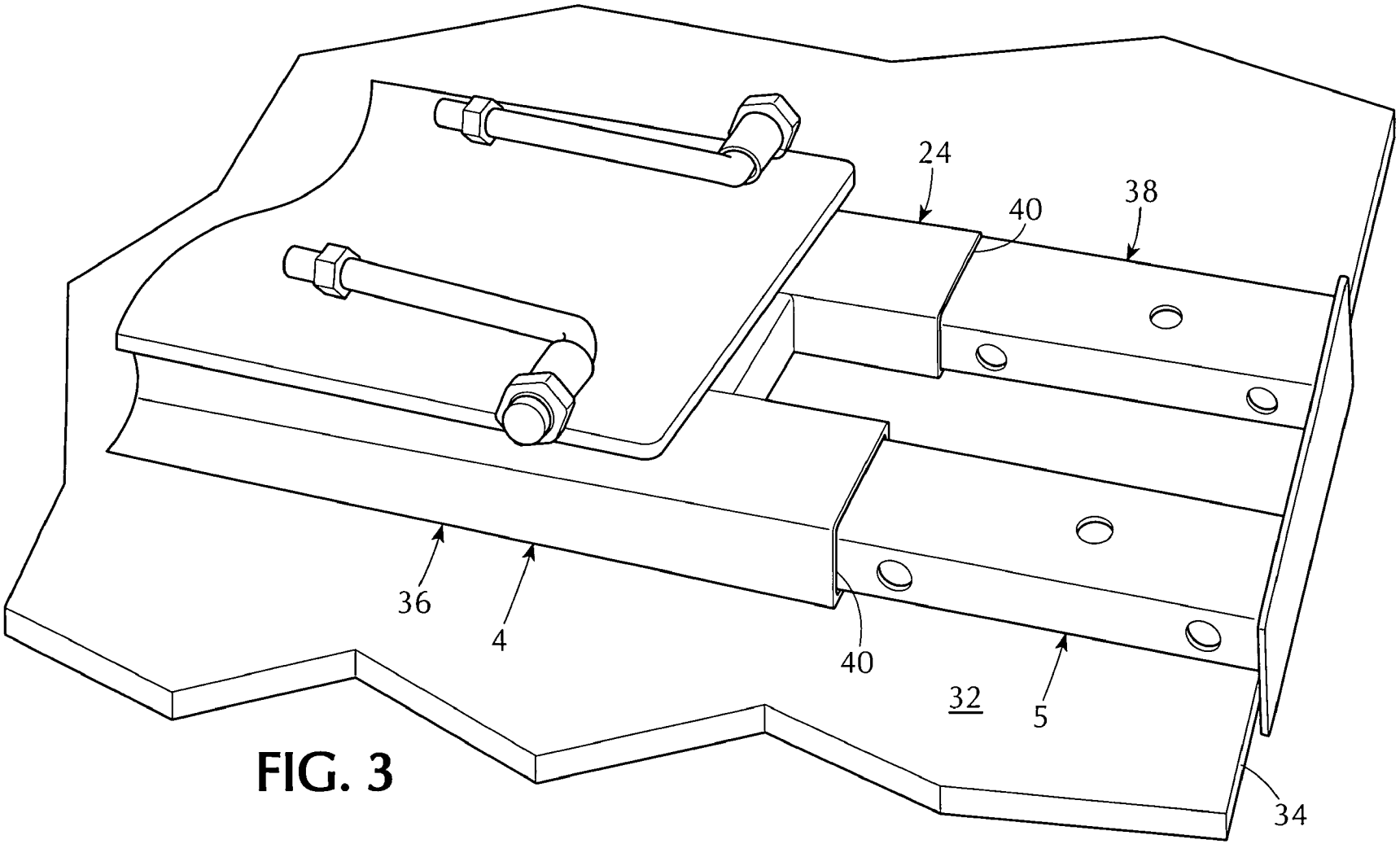
FIG. 3 is an enlarged diagrammatic perspective view of the stationary base assembly identified by ARROW 3 in FIGS. 1 and 2.
Figure 4:
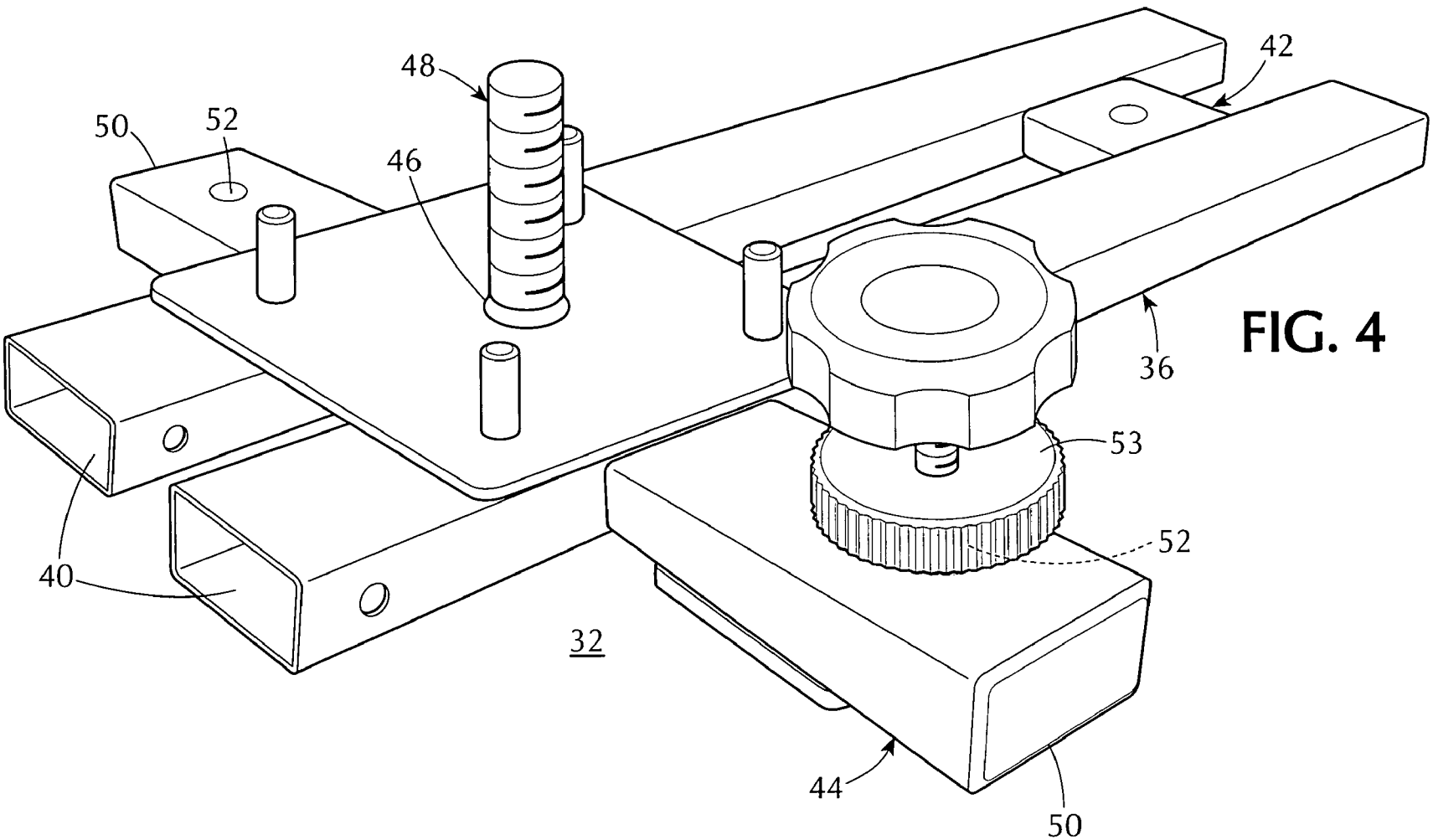
FIG. 4 is a diagrammatic perspective view of the fixed portion of the stationary base assembly identified by ARROW 4 in FIG. 3.
Figure 5:
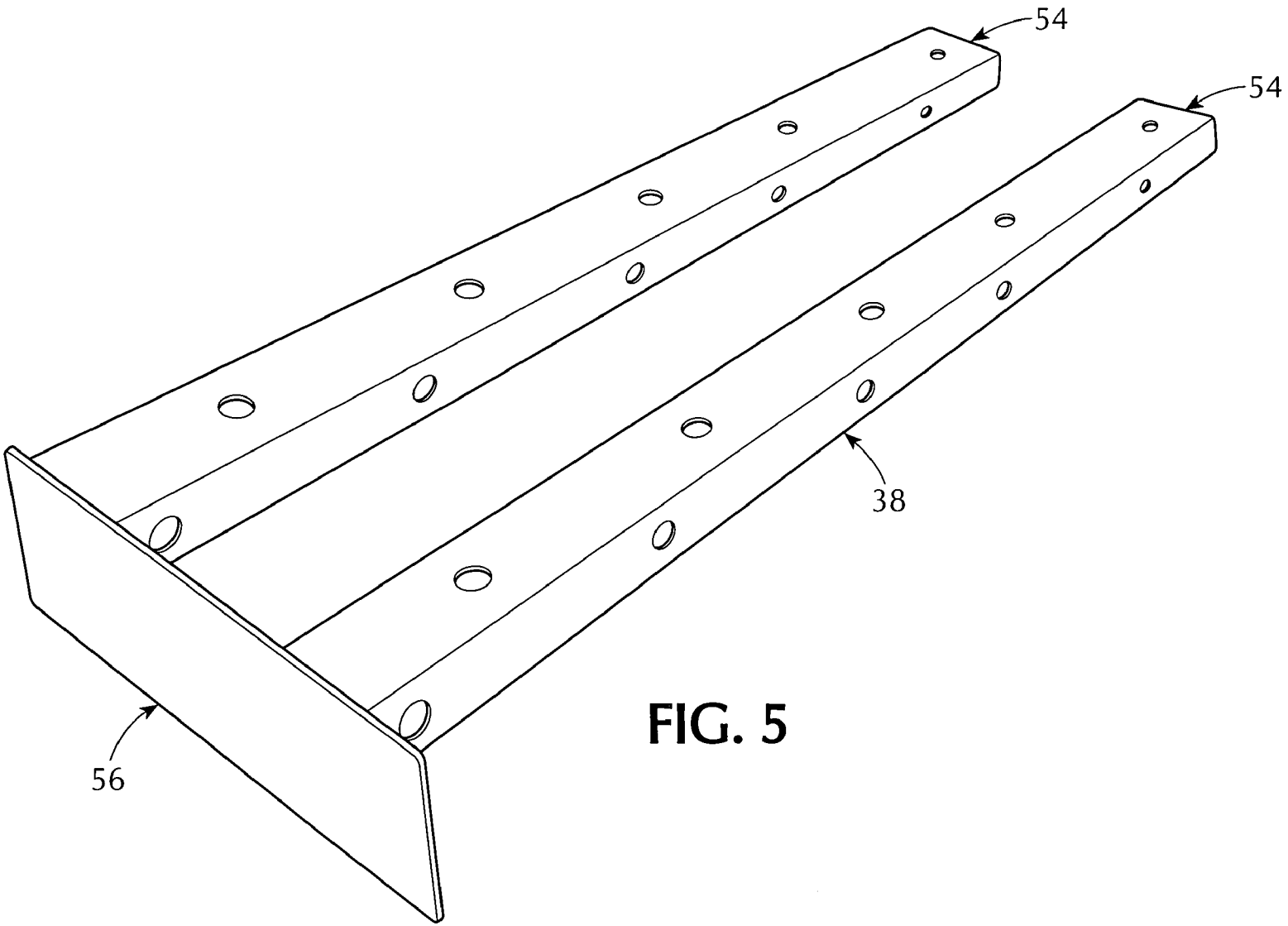
FIG. 5 is a diagrammatic perspective view of the movable portion of the stationary base assembly identified by ARROW 5 in FIG. 3.

The specific configuration of the stationary base assembly 24 can best be seen in FIGS. 3-5, which are, respectively, an enlarged diagrammatic perspective view of the stationary base assembly identified by ARROW 3 in FIGS. 1 and 2, a diagrammatic perspective view of the fixed portion of the stationary base assembly identified by ARROW 4 in FIG. 3, and a diagrammatic perspective view of the movable portion of the stationary base assembly identified by ARROW 5 in FIG. 3, and as such, will be discussed with reference thereto.

The stationary base assembly 24 comprises a fixed portion 36 and an extendable grip arm 38. The fixed portion 36 of the stationary base assembly 24 has a pair of axial channels 40 and is for resting on the bench top 32. The extendable grip arm 38 of the stationary base assembly 24 slides into and out of either end of the fixed portion 36 of the stationary base assembly 24 so as to be adjustable and is for engaging the edge 34 of the bench top 32 and is for transferring recoil from the rest 20 to the bench top 32 to thereby allow the bench top 32 to provide necessary resistance for the recoil attenuating assembly 28.

As shown in FIG. 4, the fixed portion 36 of the stationary base assembly 24 is generally T-shaped, and as such, has an axial part 42 and a transverse part 44. The transverse part 44 of the fixed portion 36 of the stationary base assembly 24 crosses the axial part 42 of the fixed portion 36 of the stationary base assembly 24 at a crossover point 46.

The crossover point 46 of the fixed portion 36 of the stationary base assembly 24 has a threaded shaft 48 extending upwardly therefrom.

The transverse part 44 of the fixed portion 32 of the stationary base assembly 24 has a pair of free ends 50 containing a pair of threaded through bores 52, respectively.

The fixed portion 32 of the stationary base assembly 24 further has a pair of adjustable elevation jacks with locking knobs 53. The pair of adjustable elevation jacks with locking knobs 53 of the fixed portion 32 of the stationary base assembly 24 threadably engage in the pair of threaded through bores 52 of the pair of free ends 50 of the transverse part 44 of the fixed portion 32 of the stationary base assembly 24, respectively, and assure leveling of the stationary base assembly 24.

As shown in FIG. 5, the extendable grip arm 38 of the stationary base assembly 24 is generally U-shaped, and as such, has a pair of axial parts 54 and a cross member 56. The pair of axial parts 54 of the extendable grip arm 38 of the stationary base assembly 24 slide into and out of either end of the pair of axial channels 40 of the fixed portion 32 of the stationary base assembly 24, respectively. The cross member 56 of the extendable grip arm 38 of the stationary base assembly 24 depends lower than the pair of axial parts 54 of the extendable grip arm 38 of the stationary base assembly 24 and is for abutting against the edge 34 of the bench top 32.

D. The Specific Configuration of the Rotating Base Assembly 26

Figure 6:
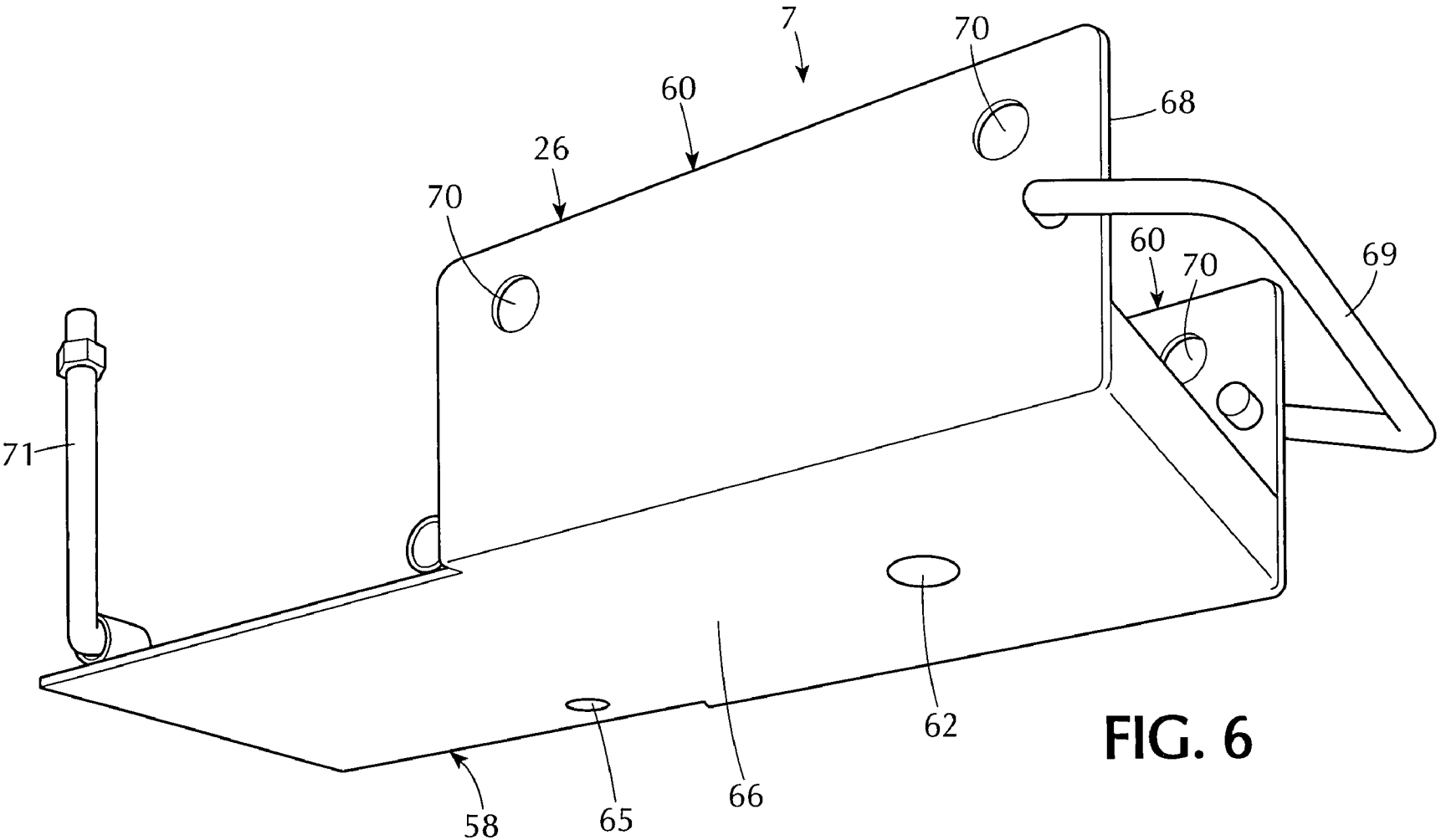
FIG. 6 is an enlarged diagrammatic perspective view of the rotating base assembly identified by ARROW 6 in FIGS. 1 and 2.
Figure 7:
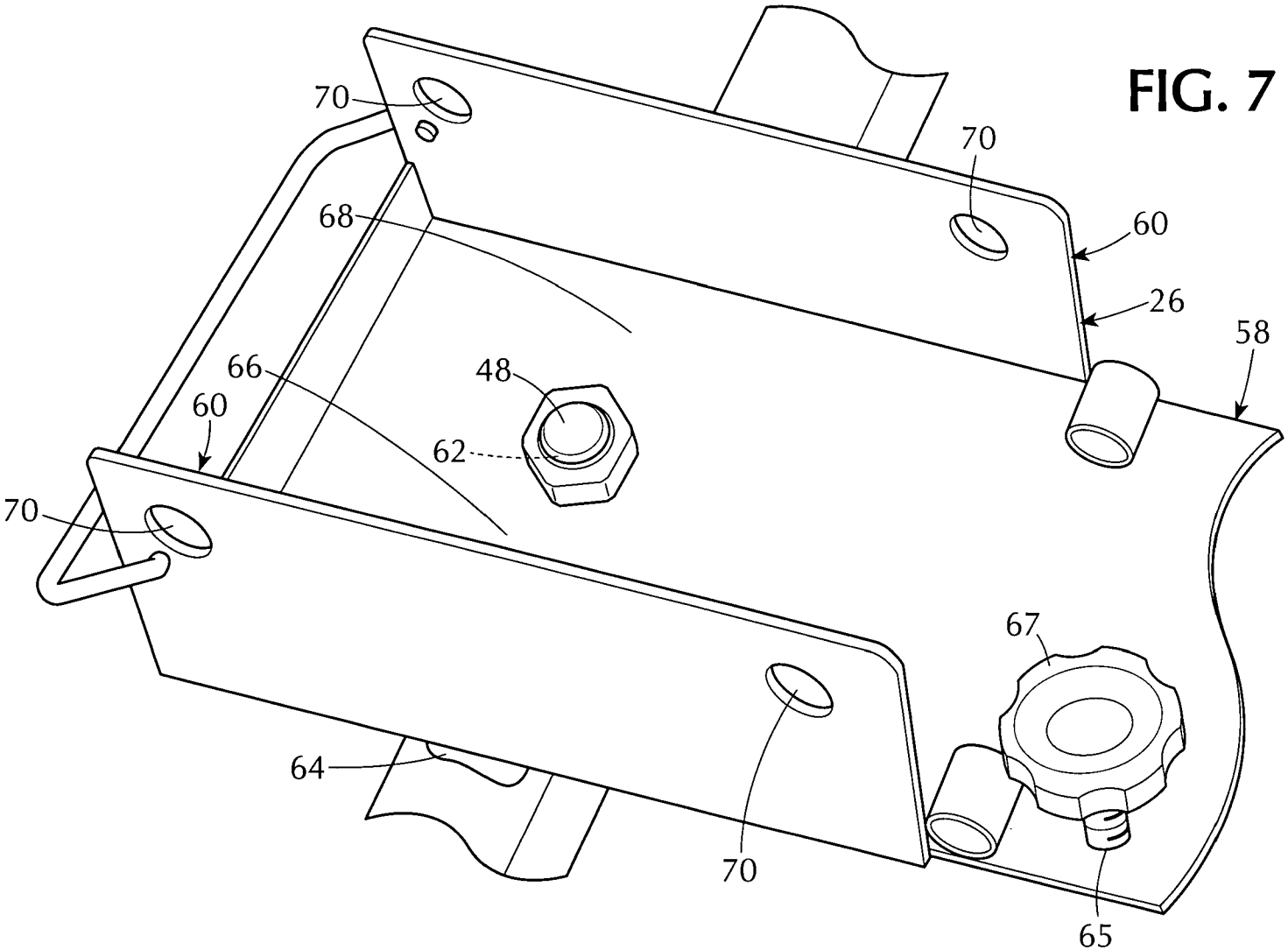
FIG. 7 is a diagrammatic perspective view taken generally in the direction of ARROW 7 in FIG. 6.

The specific configuration of the rotating base assembly 26 can best be seen in FIGS. 6 and 7, which are, respectively, an enlarged diagrammatic perspective view of the rotating base assembly identified by ARROW 6 in FIGS. 1 and 2, and a diagrammatic perspective view taken generally in the direction of ARROW 7 in FIG. 6, and as such, will be discussed with reference thereto.

The rotating base assembly 26 comprises a base part 58 and a pair of side parts 60. The base part 58 of the rotating base assembly 26 is generally flat and has a through bore 62 that rotatably receives the threaded shaft 48 of the fixed portion 32 of the stationary base assembly 24, with a thrust bearing 64 therebetween to assist in rotating the rotating base assembly 26 relative to the stationary base assembly 24 (FIG. 7).

The pair of side parts 60 of the rotating base assembly 26 extend upwardly from a portion 66 of the base part 58 of the rotating base assembly 26, and as such, define a chamber 68 therebetween.

The rotating base assembly 26 further comprises a carrying handle 69. The carrying handle 69 of the rotating base assembly 26 pivotally extends forwardly from the pair of side parts 60 of the rotating base assembly 26 and assist in carrying the dampened recoil rest 20.

Each side part 60 of the rotating base assembly 26 has a pair of through bores 70.

The rotating base assembly 26 further comprises a pair of adjustable supports 71. Each adjustable support 71 of the rotating base assembly 26 is generally L-shaped, is pivotally mounted to the base part 58 of the rotating base assembly 26, and is for maintaining a constant elevation of the recoil attenuating assembly 28.

The base part 58 of the rotating base assembly 26 has a threaded through bore 65. The threaded through bore 65 of the base part 58 of the rotating base assembly 26 is disposed rearward of the pair of side parts 60 of the rotating base assembly 26, and threadably receives a knobbed screw 67 that selectively threadably engages into one axial channel 40 of the fixed portion 32 of the stationary base assembly 24, and when engaged, locks the rotating base assembly 26 to the stationary base assembly 24 to prevent lateral movement of the rotating base assembly 26.

E. The Specific Configuration of the Recoil Attenuating Assembly 28

Figure 8:
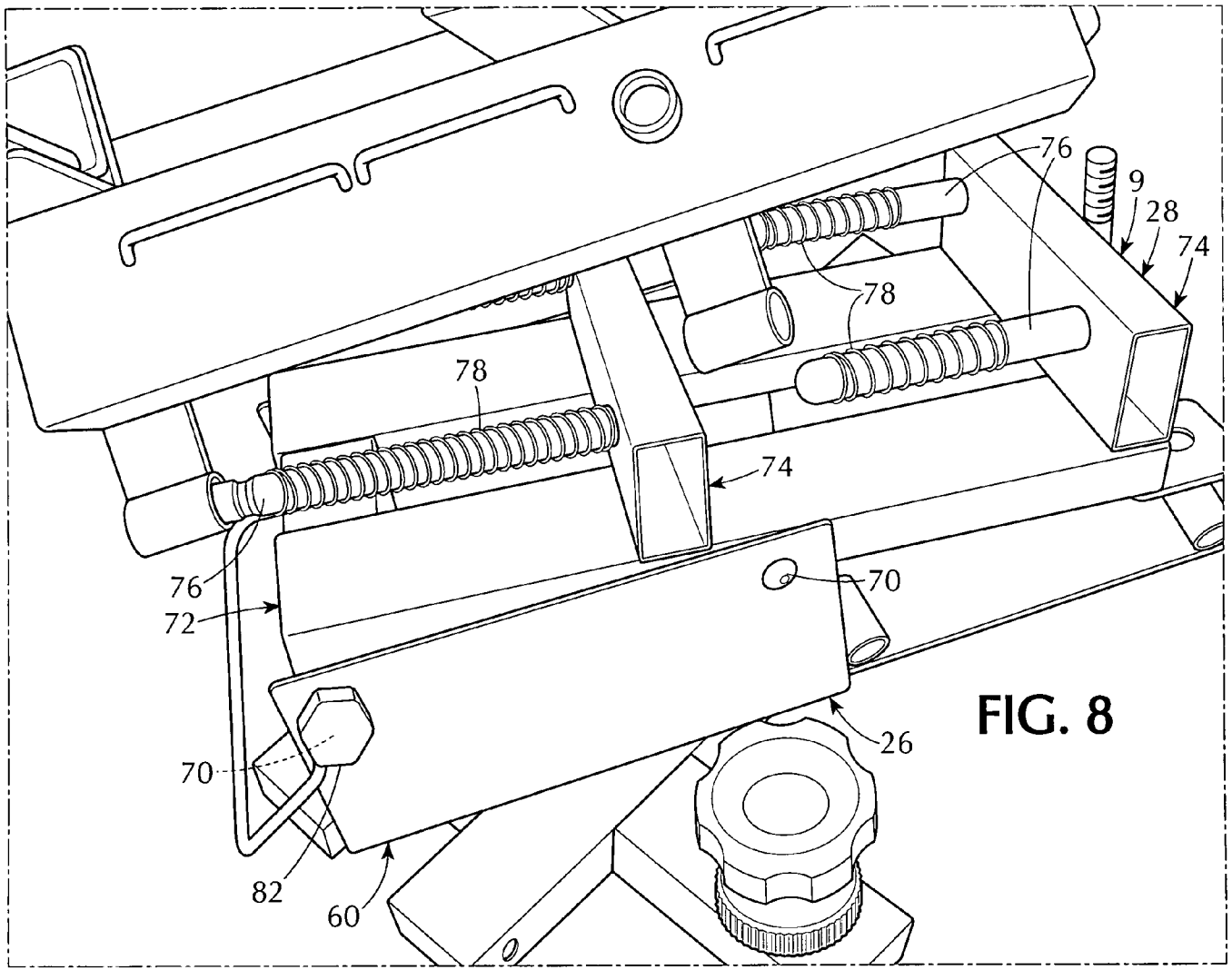
FIG. 8 is an enlarged diagrammatic perspective view of the recoil attenuating assembly identified by ARROW 8 in FIGS. 1 and 2.
Figure 9:
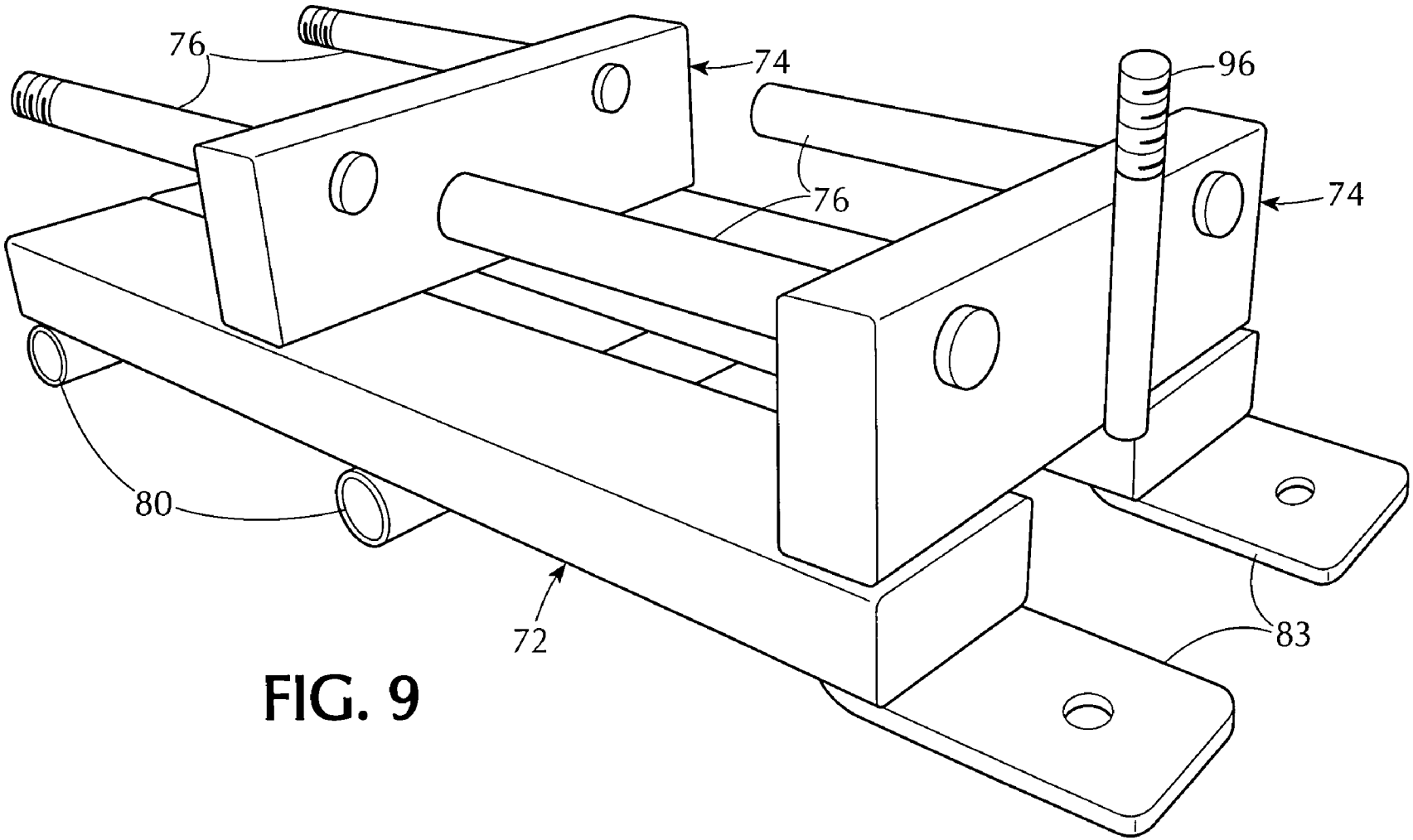
FIG. 9 is a diagrammatic perspective view of the frame of the recoil attenuating assembly identified by ARROW 9 in FIG. 8.

The specific configuration of the recoil attenuating assembly 28 can best be seen in FIGS. 8 and 9, which are, respectively, an enlarged diagrammatic perspective view of the recoil attenuating assembly identified by ARROW 8 in FIGS. 1 and 2, and a diagrammatic perspective view of the frame of the recoil attenuating assembly identified by ARROW 9 in FIG. 8, and as such, will be discussed with reference thereto.

The recoil attenuating assembly 28 comprises a base part 72 and a pair of upright parts 74. The pair of upright parts 74 of the recoil attenuating assembly 28 extend upwardly from the base part 72 of the recoil attenuating assembly 28.

Each upright part 74 of the recoil attenuating assembly 28 has a pair of rods 76. The pair of rods 76 of each upright part 74 of the recoil attenuating assembly 28 are spaced apart from each other and extend rearwardly therefrom.

The recoil attenuating assembly 28 further comprises two pair of coil springs 78. The two pair of coil springs 78 of the recoil attenuating assembly 28 fit around the pair of rods 76 of each upright part 74 of the recoil attenuating assembly 28, respectively.

The base part 72 of the recoil attenuating assembly 28 has a pair of sleeves 80 extending transversely thereunder, and is captured in the chamber 68 of the rotating base assembly 26 by fasteners 82 passing through the pair of through bores 70 of each side part 60 of the rotating base assembly 26 and the pair of sleeves 80 of the base part 72 of the recoil attenuating assembly 28.

The base part 72 of the recoil attenuating assembly 28 further has a pair of tabs 83. The pair of tabs 83 of the base part 72 of the recoil attenuating assembly 28 extend rearwardly therefrom and receive the pair of adjustable supports 69 of the rotating base assembly 26, respectively.

F. The Specific Configuration of the Rifle Support Assembly 30

Figure 10:
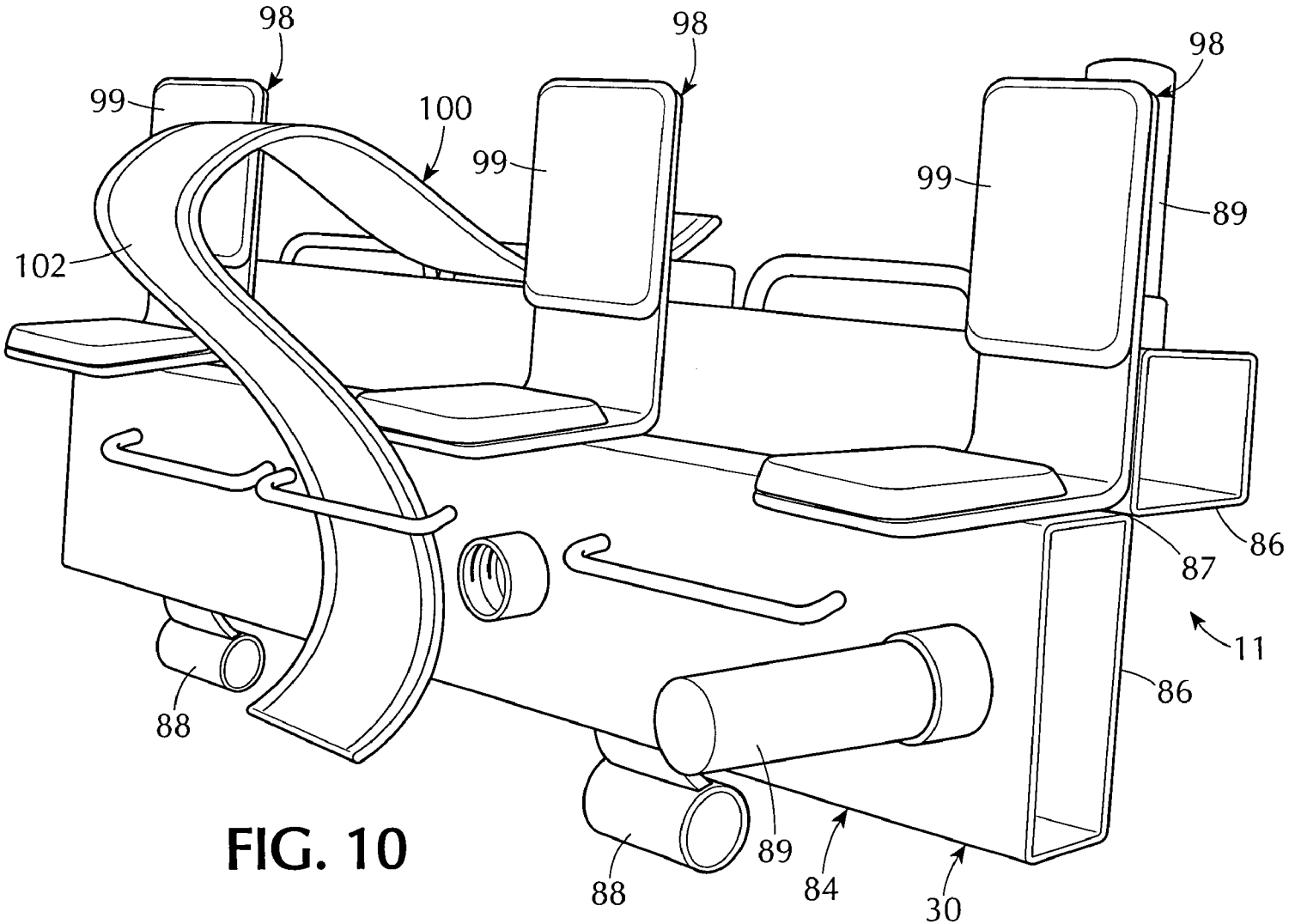
FIG. 10 is an enlarged diagrammatic perspective view of the rifle support fixture assembly identified by ARROW 10 in FIGS. 1 and 2.

The specific configuration of the rifle support assembly 30 can best be seen in FIGS. 10 and 11, which are, respectively, an enlarged diagrammatic perspective view of the rifle support assembly identified by ARROW 10 in FIGS. 1 and 2, and a diagrammatic bottom plan view taken generally in the direction of ARROW 11 in FIG. 10, and as such, will be discussed with reference thereto.

The rifle support assembly 30 comprises a body 84. The body 84 of the rifle support assembly 30 is generally V-shaped, and as such, has a pair of banks 86 joined at a junction 87.

The rifle support assembly 30 further comprises two pair of sleeves 88. Each pair of sleeves 88 of the rifle support assembly 30 are aligned with each other, depend from a respective bank 86 of the body 84 of the rifle support assembly 30, and freely receive an associated pair of rods 76 of the pair of upright parts 74 of the recoil attenuating assembly 28, and in so doing, biases the two pair of coil springs 78 of the recoil attenuating assembly 28 thereagainst so as to allow the rifle support assembly 30 to bias away from the recoil attenuating assembly 28.

The rifle support assembly 30 further comprises a pair of threaded pins 89. The pair of threaded pins 89 of the rifle support assembly 30 extend perpendicularly outwardly from the pair of banks 86 of the body 84 of the rifle support assembly 30, respectively.

As shown in FIG. 1, The rifle support assembly 30 further comprises a strap 91 having multiple loops 93 therealong. A loop 93 on one side of the strap 91 of the rifle support assembly 30 receives one threaded pin 89 of the rifle support assembly 30, while a loop 93 on the other side of the strap 91 of the rifle support assembly 30 receives the other threaded pin 89 of the rifle support assembly 30, with the strap 91 of the rifle support assembly 30 being around the stock of the rifle 22 so as to allow the strap 91 of the rifle support assembly 30 to transfer the recoil from the rifle 22 to the recoil attenuating assembly 28.

Figure 11:
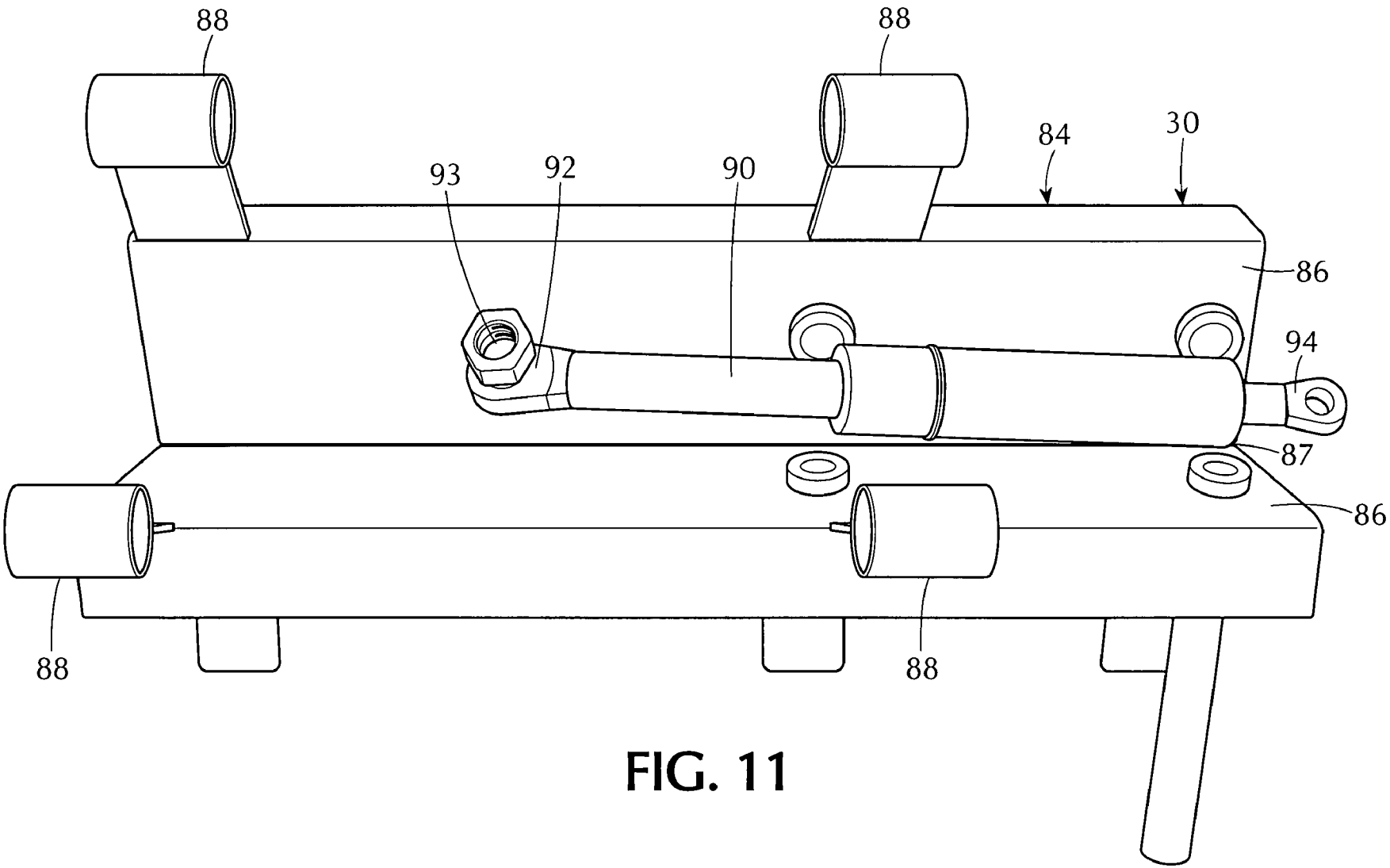
FIG. 11 is a diagrammatic bottom plan view taken generally in the direction of ARROW 11 in FIG. 10.

As shown in FIG. 11, the rifle support assembly 30 further comprises a compression damper 90. The compression damper 90 of the rifle support assembly 30 is dependingly cradled in the junction 87 of the body 84 of the rifle support assembly 30, and is attached at one end 92 thereof to the rifle support assembly 30 by a mounting stud 93, and is attached at the other end 94 thereof to a threaded rod 96 of the recoil attenuating assembly 28 (FIG. 9).

The rifle support assembly 30 further comprises cleats 98. The cleats 98 of the rifle support assembly 30 are aligned with each other, extend upwardly from the junction 87 of the body 84 of the rifle support assembly 30, and are lined with foam pads 99 for safely supporting the rifle 22. The foam pads 99 of the cleats 98 of the rifle support assembly 30 are thick enough to provide clearance for fittings on the rifle 22, such as the forward sling swivel stud.

The rifle support assembly 30 further comprises a strap 100. The strap 100 of the rifle support assembly 30 is operatively connected to the body 84 of the rifle support assembly 30 and is faced with hook and loop fasteners 102 for retaining the rifle 22 in the rifle support assembly 30.

G. The Impressions

It will be understood that each of the elements described above or two or more together may also find a useful application in other types of constructions differing from the types described above.

While the embodiments of the present invention have been illustrated and described as embodied in a dampened recoil rest for supporting a rifle for enabling a shooter to operate the rifle with adjustable attenuation of recoil felt by the shooter, eliminating damage to the rifle by progressively absorbing or attenuating recoil, with the sight remaining on the target thereby eliminating a need to reacquire the target, without having to add additional weight to absorb the recoil, and with comfortable transfer of the recoil from the rifle to the shooter's shoulder, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A dampened recoil rest for supporting a rifle having a sight and being for enabling a shooter to operate the rifle with adjustable attenuation of recoil felt by the shooter, eliminating damage to the rifle by progressively absorbing or attenuating recoil, with the sight remaining on the target thereby eliminating a need to reacquire the target, without having to add additional weight to absorb the recoil, and with transfer of the recoil from the rifle to the shooter's shoulder, comprising:

a) a stationary base assembly;

b) a rotating base assembly;

c) a recoil attenuating assembly; and d) a rifle support assembly;

wherein said stationary base assembly is for attaching to a bench top having an edge;

wherein said rotating base assembly is rotatably attached to said stationary base assembly;

wherein said recoil attenuating assembly is operatively connected to said rotating base assembly;

wherein said recoil attenuating assembly is for enabling the shooter to operate the rifle with adjustable attenuation of the recoil felt by the shooter, with the sight remaining on the target thereby eliminating a need to reacquire the target, without having to add additional weight to absorb the recoil, with the transfer of the recoil from the rifle to the shooter's shoulder, and to eliminate damage to the rifle by progressively absorbing or attenuating recoil;

wherein said rifle support assembly is operatively connected to said recoil attenuating assembly;

wherein said rifle support assembly is for supporting the rifle;

wherein said stationary base assembly comprises a fixed portion;

wherein said stationary base assembly comprises an extendable grip arm;

wherein said fixed portion of said stationary base assembly has a pair of axial channels;

wherein said fixed portion of said stationary base assembly is for resting on the bench top;

wherein said fixed portion of said stationary base assembly is generally T-shaped, and as such, has an axial part and a transverse part;

wherein said transverse part of said fixed portion of said stationary base assembly crosses said axial part of said fixed portion of said stationary base assembly at a crossover point; and wherein said crossover point of said fixed portion of said stationary base assembly has a threaded shaft extending upwardly therefrom.

2. The rest of claim 1, wherein said extendable grip arm of said stationary base assembly slides into and out of either end of said fixed portion of said stationary base assembly so as to be adjustable;

wherein said extendable grip arm of said stationary base assembly is for engaging the edge of the bench top; and wherein said grip arm of said stationary base assembly is for transferring recoil from said rest to the bench top to thereby allow the bench top to provide necessary resistance for said recoil attenuating assembly.

3. The rest of claim 1, wherein said transverse part of said fixed portion of said stationary base assembly has a pair of free ends containing a pair of threaded through bores, respectively.

4. The rest of claim 3, wherein said fixed portion of said stationary base assembly has a pair of adjustable elevation jacks with locking knobs.

5. The rest of claim 4, wherein said pair of adjustable elevation jacks with locking knobs of said fixed portion of said stationary base assembly threadably engage in said pair of threaded through bores of said pair of free ends of said transverse part of said fixed portion of said stationary base assembly, respectively, and assure leveling of said stationary base assembly.

6. The rest of claim 1, wherein said extendable grip arm of said stationary base assembly is generally U-shaped, and as such, has a pair of axial parts and a cross member.

7. The rest of claim 6, wherein said pair of axial parts of said extendable grip arm of said stationary base assembly slide into and out of either end of said pair of axial channels of said fixed portion of said stationary base assembly, respectively.

8. The rest of claim 6, wherein said cross member of said extendable grip arm of said stationary base assembly depends lower than said pair of axial parts of said extendable grip arm of said stationary base assembly for abutting against the edge of the bench top.

9. The rest of claim 1, wherein said rotating base assembly comprises a base part; and wherein said rotating base assembly comprises a pair of side parts.

10. The rest of claim 9, wherein said base part of said rotating base assembly is generally flat; and wherein said base part of said rotating base assembly has a through bore that rotatably receives said threaded shaft of said fixed portion of said stationary base assembly.

11. The rest of claim 9, wherein said pair of side parts of said rotating base assembly extend upwardly from a portion of said base part of said rotating base assembly, and as such, define a chamber therebetween.

12. The rest of claim 9, wherein said rotating base assembly comprises a carrying handle.

13. The rest of claim 12, wherein said carrying handle of said rotating base assembly pivotally extends forwardly from said pair of side parts of said rotating base assembly; and wherein said carrying handle of said rotating base assembly assists in carrying said dampened recoil rest.

14. The rest of claim 11, wherein each side part of said rotating base assembly has a pair of through bores.

15. The rest of claim 9, wherein said rotating base assembly comprises a pair of adjustable supports.

16. The rest of claim 15, wherein each adjustable support of said rotating base assembly is generally L-shaped;

wherein each adjustable support of said rotating base assembly is pivotally mounted to said base part of said rotating base assembly, and wherein each adjustable support of said rotating base assembly is for maintaining a constant elevation of said recoil attenuating assembly.

17. The rest of claim 14, wherein said recoil attenuating assembly comprises a base part; and wherein said recoil attenuating assembly comprises a pair of upright parts.

18. The rest of claim 17, wherein said pair of upright parts of said recoil attenuating assembly extend upwardly from said base part of said recoil attenuating assembly.

19. The rest of claim 18, wherein each upright part of said recoil attenuating assembly has a pair of rods.

20. The rest of claim 19, wherein said pair of rods of each upright part of said recoil attenuating assembly are spaced apart from each other; and wherein said pair of rods of each upright part of said recoil attenuating assembly extend forwardly from said each upright part of said recoil attenuating assembly.

21. The rest of claim 20, wherein said recoil attenuating assembly comprises two pair of coil springs.

22. The rest of claim 21, wherein said two pair of coil springs of said recoil attenuating assembly fit around said pair of rods of each upright part of said recoil attenuating assembly, respectively.

23. The rest of claim 17, wherein said base part of said recoil attenuating assembly comprises a pair of sleeves extending transversely thereunder.

24. The rest of claim 23, wherein said pair of sleeves of said base part of said recoil attenuating assembly is captured in said chamber of said rotating base assembly by fasteners.

25. The rest of claim 24, wherein said fasteners of said base part of said recoil attenuating assembly pass through said pair of through bores of each side part of said rotating base assembly and said pair of sleeves of said base part of said recoil attenuating assembly.

26. The rest of claim 15, wherein said base part of said recoil attenuating assembly comprises a pair of tabs.

27. The rest of claim 26, wherein said pair of tabs of said base part of said recoil attenuating assembly extend rearwardly therefrom; and wherein said pair of tabs of said base part of said recoil attenuating assembly receive said pair of adjustable supports of said rotating base assembly, respectively.

28. The rest of claim 21, wherein said rifle support assembly comprises a body.

29. The rest of claim 28, wherein said body of said rifle support assembly is generally V-shaped, and as such, has a pair of banks joined at a junction.

30. The rest of claim 29, wherein said rifle support assembly comprises two pair of sleeves.

31. The rest of claim 30, wherein each pair of sleeves of said rifle support assembly are aligned with each other;

wherein each pair of sleeves of said rifle support assembly depend from a respective bank of said body of said rifle support assembly; and wherein each pair of sleeves of said rifle support assembly freely receive an associated pair of rods of said pair of upright parts of said recoil attenuating assembly, and in so doing, biases said two pair of coil springs of said recoil attenuating assembly thereagainst so as to allow said rifle support assembly to bias away from said recoil attenuating assembly.

32. The rest of claim 29, wherein said rifle support assembly comprises a compression damper.

33. The rest of claim 32, wherein said compression damper of said rifle support assembly is dependingly cradled in said junction of said body of said rifle support assembly; and wherein said compression damper of said rifle support assembly is attached at one end thereof to said rifle support assembly by a mounting stud, and is attached at the other end thereof to a threaded rod of said recoil attenuating assembly.

34. The rest of claim 29, wherein said rifle support assembly comprises cleats.

35. The rest of claim 34, wherein said cleats of said rifle support assembly are aligned with each other; and wherein said cleats of said rifle support assembly extend upwardly from said junction of said body of said rifle support assembly.

36. The rest of claim 34, wherein said cleats of said rifle support assembly are lined with foam pads for safely supporting the rifle; and wherein said foam pads of said cleats of said rifle support assembly are thick enough to provide clearance for fittings on the rifle.

37. The rest of claim 28, wherein said rifle support assembly comprises a strap.

38. The rest of claim 37, wherein said strap of said rifle support assembly is operatively connected to said body of said rifle support assembly.

39. The rest of claim 37, wherein said strap of said rifle support assembly is faced with hook and loop fasteners for retaining the rifle in said rifle support assembly.

40. The rest of claim 10, wherein said rotating base comprises a thrust bearing; and wherein said thrust bearing is between said rotating base assembly and said stationary base assembly to assist in rotating said rotating base assembly relative to said stationary base assembly.

41. The rest of claim 29, wherein said rifle support assembly comprises a pair of threaded pins; and wherein said pair of threaded pins of said rifle support assembly extend perpendicularly outwardly from said pair of banks of said body of said rifle support assembly, respectively.

42. The rest of claim 41, wherein said rifle support assembly comprises a strap having multiple loops therealong; and wherein a loop on one side of said strap of said rifle support assembly receives one threaded pin of said rifle support assembly, while a loop on the other side of said strap of said rifle support assembly receives the other threaded pin of said rifle support assembly, with said strap of said rifle support assembly being around the stock of the rifle so as to allow said strap of said rifle support assembly to transfer recoil from the rifle to said recoil attenuating assembly.

43. The rest of claim 9, wherein said base part of said rotating base assembly has a threaded through bore;

wherein said threaded through bore of said base part of said rotating base assembly is disposed rearward of said pair of side parts of said rotating base assembly;

wherein said threaded through bore of said base part of said rotating base assembly threadably receives a knobbed screw; and wherein said knobbed screw of said rotating base assembly selectively threadably engages into one axial channel of said fixed portion of said stationary base assembly, and when engaged, locks said rotating base assembly to said stationary base assembly to prevent lateral movement of said rotating base assembly.

* * * * *